US007434628B2

(12) United States Patent
Scheidt

(10) Patent No.: US 7,434,628 B2
(45) Date of Patent: Oct. 14, 2008

(54) METHOD AND APPARATUS FOR EXTINGUISHING A FIRE IN AN ENCLOSED SPACE

(75) Inventor: Alexander Scheidt, Bremen (DE)

(73) Assignee: Airbus Deutschland GmbH, Hamburg (DE)

( * ) Notice: Subject to any disclaimer, the term of this patent is extended or adjusted under 35 U.S.C. 154(b) by 657 days.

(21) Appl. No.: 11/023,974

(22) Filed: Dec. 23, 2004

(65) Prior Publication Data

US 2005/0139366 A1 Jun. 30, 2005

(30) Foreign Application Priority Data

Dec. 24, 2003 (DE) ..... 103 61 020

(51) Int. Cl.
*A62C 35/00* (2006.01)
*A62C 3/06* (2006.01)

(52) U.S. Cl. ..... 169/7; 169/9; 169/16; 169/56; 239/63

(58) Field of Classification Search ..... 169/7, 169/9, 16, 46; 239/63, 67, 69
See application file for complete search history.

(56) References Cited

U.S. PATENT DOCUMENTS

| | | | | |
|---|---|---|---|---|
| 2,539,452 | A | | 1/1951 | Mapes |
| 3,783,946 | A | | 1/1974 | Petrinec et al. |
| 3,893,514 | A | | 7/1975 | Carhart et al. |
| 3,917,001 | A | * | 11/1975 | Davis et al. ..... 169/61 |
| 4,351,394 | A | | 9/1982 | Enk |
| 4,566,542 | A | | 1/1986 | Enk et al. |
| 4,643,260 | A | | 2/1987 | Miller |
| 4,726,426 | A | | 2/1988 | Miller |
| 5,038,867 | A | | 8/1991 | Hindrichs et al. |
| 5,183,116 | A | | 2/1993 | Fleming |
| 5,857,525 | A | | 1/1999 | Okamoto et al. |
| 6,003,608 | A | | 12/1999 | Cunningham |
| 6,029,751 | A | | 2/2000 | Ford et al. |
| 6,053,256 | A | | 4/2000 | Lu |
| 6,082,464 | A | | 7/2000 | Mitchell et al. |
| 6,314,754 | B1 | | 11/2001 | Kotliar |
| 6,390,203 | B1 | | 5/2002 | Borisov et al. |

(Continued)

FOREIGN PATENT DOCUMENTS

| | | |
|---|---|---|
| DE | 42 36 544 | 5/1994 |

(Continued)

*Primary Examiner*—Len Tran
*Assistant Examiner*—Daniel T Sharpe
(74) *Attorney, Agent, or Firm*—W. F. Fasse; W. G. Fasse

(57) ABSTRACT

A system for fighting a fire in an enclosed space has at least one container (3) for holding a fire extinguishing agent under pressure. A pipe system connects a container outlet to a discharge in the enclosed space. A controllable flow control valve (5) in the pipe system is responsive to a flow control signal generated by a control unit (4) in response to sensed characteristics (pressure and/or temperature) of the agent. A trigger action initially opens the container to the pipe system. The valve is initially held open until concentration (A) of fire extinguishing agent in the enclosed space is sufficient to suffocate a started fire. Thereafter, the valve is opened intermittently to maintain a lower concentration of fire extinguishing agent in the space sufficient to prevent rekindling. More than one container may be used but only one is equipped with a valve controllable by a control unit.

6 Claims, 2 Drawing Sheets

U.S. PATENT DOCUMENTS

| | | | |
|---|---|---|---|
| 6,418,752 | B2 | 7/2002 | Kotliar |
| 6,601,653 | B2 | 8/2003 | Grabow et al. |
| 6,619,404 | B2 | 9/2003 | Grabow |
| 6,676,081 | B2 | 1/2004 | Grabow et al. |
| 2002/0040940 | A1 | 4/2002 | Wagner et al. |
| 2002/0070035 | A1 * | 6/2002 | Grabow et al. ..... 169/16 |

FOREIGN PATENT DOCUMENTS

| | | |
|---|---|---|
| EP | 1 147 789 | 10/2001 |
| SU | 971 365 | 11/1982 |
| WO | WO 81/01796 | 7/1981 |

* cited by examiner

METHOD AND APPARATUS FOR EXTINGUISHING A FIRE IN AN ENCLOSED SPACE

PRIORITY CLAIM

This application is based on and claims the priority under 35 U.S.C. §119 of German Patent Application 103 61 020.0, filed on Dec. 24, 2003, the entire disclosure of which is incorporated herein by reference.

FIELD OF THE INVENTION

A fire is extinguished in any enclosed space, for example in the cargo hold of an aircraft, a ship, or any other conveyance having an enclosed space, such as a car. A fire extinguishing agent is stored in at least one container which is connected through a pipe system to at least one discharge nozzle in the enclosed space. A method for extinguishing a fire uses such system.

BACKGROUND INFORMATION

Firefighting in civilian, particularly commercial, and military aircraft requires equipment which uses halons, also known as halogen hydrocarbons, as fire extinguishing agents. However, the use of such halons is discouraged in view of their presumed adverse effect on the environment. Thus, halon replacement agents are known which have comparable fire extinguishing characteristics, however with a lesser adverse effect regarding the so-called greenhouse effect. In other words, halon replacements have a smaller or no adverse effect on the ozone layer. Halons assume their liquid state under a pressure of about 25 bar (gage) and are stored in suitable containers for holding these fire extinguishing agents, for example in an aircraft. Generally, such containers have an outlet that is normally closed with a frangible closure membrane. A nitrogen cushion is usually provided in the container above the halon in its liquid state. These membranes permit connecting the container to a distribution pipe system by destroying the membrane, for example by igniting a pyrotechnical membrane control system with an electrical spark. As soon as the membrane is destroyed, the halon flows through the pipe system to the enclosed space where a fire has started. Conventional nozzles connected to the discharge end of the pipe system distribute the fire extinguishing agent in the enclosed space. The pyrotechnical closure system is usually remote controlled through an electrical switch in the cockpit. Fire detectors are installed in the enclosed space and provide a warning signal to a control station such as the cockpit so that the release of fire extinguishing agent can be immediately triggered by a crew member or automatically.

Conventionally, the fire extinguishing agent such as halon flows without flow restriction out of a first fire extinguishing agent holding container through the pipe system to the enclosed space until the first container is empty, whereby the pressure in the container now corresponds to the atmospheric pressure or to the pressure in the aircraft cabin or loading space. The continuous discharge of fire extinguishing agent from a first container assures that a high initial concentration of extinguishing agent is provided in the enclosed space leading to a rapid suppression or suffocation of the fire.

Simultaneously with the discharging of extinguishing agent from the first container, or after a complete emptying of the first container, the pyrotechnical closure system of a second container is triggered. The second container is connected to the pipe system through a water adsorption filter and a solid particle filter positioned in a portion of the pipe system leading out of the second container into the discharge pipe system. A pressure reduction throttle is provided in this portion of the pipe system for reducing the pressure of the outflowing extinguishing agent. As a result a relatively small, strongly throttled extinguishing agent mass passes from the extinguishing agent container through the pipe system to the fire location. Such restricted mass flow nevertheless makes sure that in the enclosed space, where a fire has started, there will always be maintained an extinguishing agent concentration, which does not fall below a minimal concentration required for preventing rekindling. For this purpose a diaphragm or control aperture is arranged downstream of the pressure reducer for a precise limitation of the halon throughflow to certainly prevent rekindling. Downstream of the diaphragm or control aperture there is arranged a check valve for preventing a return flow of extinguishing agent out of the pipe system into the second container. This check valve also protects the pressure reducer against a pressure shock occurring when the first container is opened. A relatively small extinguishing agent mass flow is required for suppressing any rekindling of the fire with certainty. Thus, for example a value of the mass flow in the range of 0.05 to 0.5 kg/min is sufficient to avoid rekindling. Due to the high pressure drop of the extinguishing agent downstream of the pressure reducer, the extinguishing agent changes from its liquid phase into its gaseous phase.

It is also known that the fire extinguishing agents contain contaminations in the form of non-volatile materials such as oil, grease, solid particles or the like which have a tendency to accumulate at the location of the phase change, namely preferably in the area of the pressure reducer. This is a disadvantage which becomes worse with time due to the relatively small mass flow of the halon extinguishing agent and due to the low temperature up to −50° C. These conditions lead to an accumulation of contaminations which have a negative influence on the closed loop control characteristic of the pressure reducer which eventually may lead to a total system shut down of the entire firefighting equipment or system.

OBJECTS OF THE INVENTION

In view of the foregoing it is the aim of the invention to achieve the following objects singly or in combination:

- to avoid the shutdown of a fire extinguishing system due to the strong super-cooling of the pressure reducer and due to the accumulation of contaminations in the area of the pressure reducer;
- to avoid using a pressure reducer altogether;
- to rapidly suppress a fire that has started in an enclosed space and then to periodically prevent rekindling of a fire; and
- to provide an apparatus and method for fighting a fire in an enclosed space while avoiding the drawbacks of the prior art.

The invention further aims to avoid or overcome the disadvantages of the prior art, and to achieve additional advantages, as apparent from the present specification. The attainment of these objects is, however, not a required limitation of the claimed invention.

SUMMARY OF THE INVENTION

The above objects have been achieved in an apparatus according to the invention by the combination of the following features. At least one container for holding a fire extinguishing agent under pressure is connected through a pipe system to at least one discharge opening for discharging fire extinguishing agent into the enclosed space. A controllable flow control is positioned downstream of an outlet of the container to open a flow path from the at least one container into the pipe system. The controllable flow control, such as a valve, is connected to a control unit which operates the flow control valve in response to control determining information for controlling the flow of fire extinguishing agent through the valve into the enclosed space.

Preferably, the control determining information includes the temperature and the pressure of the extinguishing agent next to the controllable valve, and other information stored in a memory of the control unit such as a CPU. If more than one container is used, only one container needs to be equipped with a controllable flow control valve.

The above objects are also achieved by a method according to the invention comprising the following steps:

a) first discharging a fire extinguishing agent from at least one container (2) through a pipe system into an enclosed space without any flow control downstream of said at least one container, b) continuing said first discharging until an initial concentration A of fire extinguishing agent is achieved in said enclosed space, sufficient for rapidly suppressing a started fire, and c) second intermittently discharging additional fire extinguishing agent from said at least one container, through a controllable valve in the pipe system into said enclosed space sufficient for maintaining a minimal concentration (M) of fire extinguishing agent in said enclosed space sufficient to prevent any rekindling of a fire.

The first discharging of a fire distinguishing agent from a first container is preferably continued until the first container is empty. If two containers are used, the intermittently discharged agent comes from the second container.

As mentioned, the present invention can be practiced by using one or more containers holding fire extinguishing agent. Independently of the number of containers, only one fire extinguishing agent holding container needs to be equipped with a controllable valve, preferably a closed loop controlled valve responsive to a temperature and/or a pressure of the fire extinguishing agent flowing out of the one container. The respective sensors are preferably arranged close to the controllable valve downstream of the container. The valve is so controlled that first fire extinguishing agent is continuously discharged until a concentration of fire extinguishing agent in the enclosed space is sufficient for suppressing or suffocating a started fire whereupon the valve is so controlled that additional fire extinguishing agent is discharged from the same container periodically or intermittently for maintaining a minimal fire extinguishing agent concentration M in the enclosed space so that a rekindling of the fire is prevented with certainty.

Since the invention avoids using a pressure reducer downstream of any of the containers that hold a fire extinguishing agent, that source of system failure has been removed, which is an important advantage of the invention.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF A PREFERRED EXAMPLE EMBODIMENT AND OF THE BEST MODE OF THE INVENTION

The present fire extinguishing or firefighting system 1 comprises at least one container 3 for holding a fire extinguishing agent 16. Preferably, a plurality of such containers are used, for example the containers 2, 3 and 2'. The number of containers is only limited with due regard to the estimated quantity or volume of a fire extinguishing agent 16 needed for any particular volume of an enclosed space.

Figure 1:
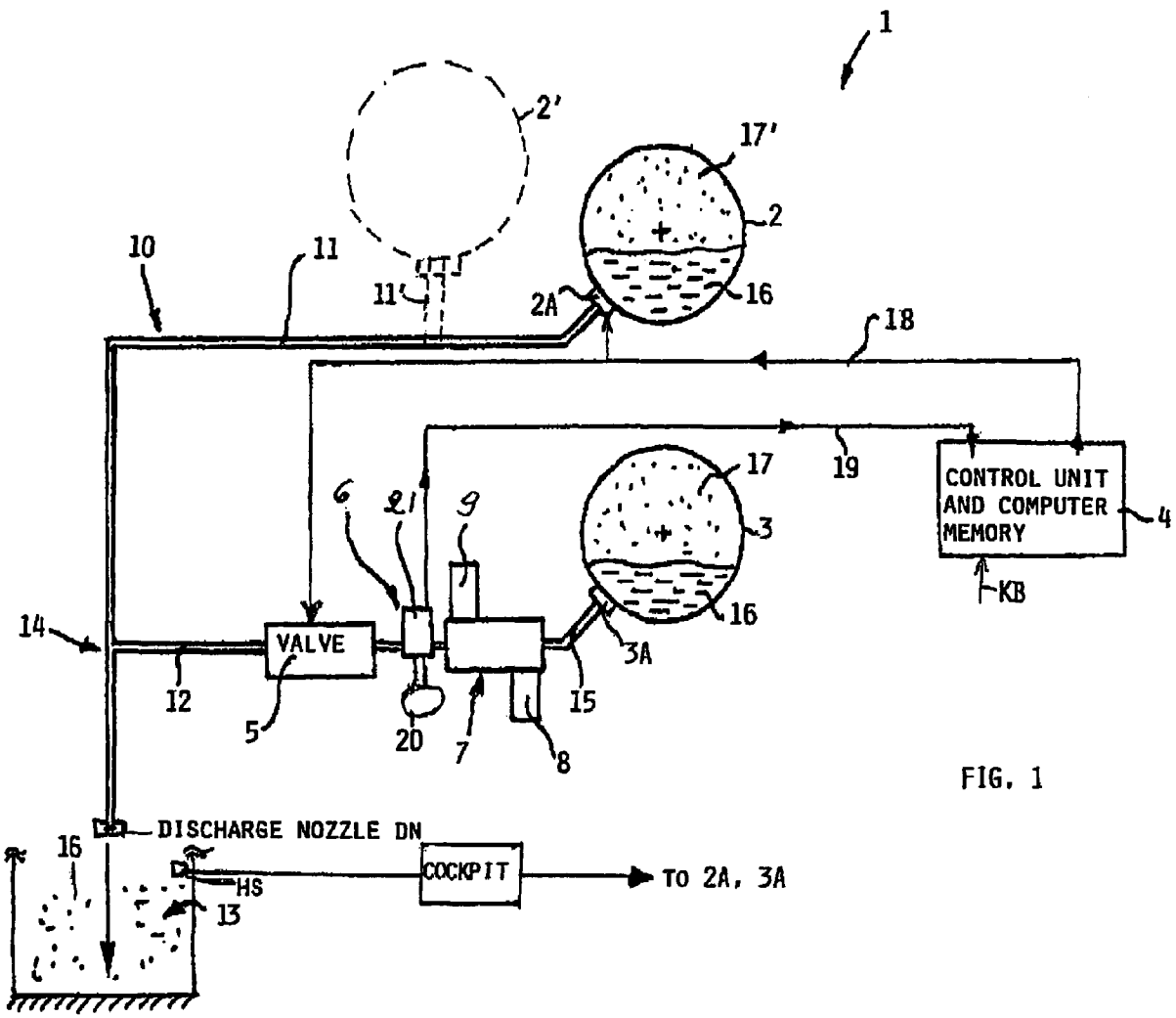
FIG. 1 is a schematic diagram of a firefighting system according to the invention avoiding the use of any flow restrictors.

As shown in FIG. 1, the system 1 comprises a first container 3 holding extinguishing agent 16 below a nitrogen cushion 17. The container 3 is connected through a frangible closure such as a membrane 3A to a pipe section 15 which leads to a filter unit 7 including a water adsorption filter 8 and a solid particle filter 9. The filter unit 7 in turn is connected through a pipe section to a sensor unit 6 including a pressure sensor 20 and a temperature sensor 21. The sensor section 6 is connected through a further pipe section to a closed loop controllable valve, such as an electrically controllable valve 5. The output port of the valve 5 is connected through a pipe section 12 and a T-junction 14 to a pipe system 10 having at least one discharge nozzle DN in an enclosed space 13 for discharging fire extinguishing agent 16 into the enclosed space 13. A heat sensor HS is installed in the space 13. Information from the heat sensor is provided to the cockpit and to a memory in a computer or central processing unit of a control unit 4.

The sensor unit 6 is connected through a sensor conductor or bus 19 to the control unit 4 which in addition to the computer and the memory has a keyboard KB for entering of a control program as well as of other control parameters to be described in more detail below.

A control output of the control unit 4 is connected through a control conductor or control bus 18 to the valve 5 and possibly, but not necessarily also to a pyrotechnical closure 2A of the container 2.

The fire extinguishing agent 16 may, for example be a halon that is in its gaseous state under normal conditions such as room temperature at 20° C. and at a barometric pressure of 1013.25 millibar (mBar). However, the agent is maintained at an excess pressure in the containers 2, 2' and 3 so that the agent 16 is in its liquid phase which is maintained by the pressurized nitrogen cushion 17, 17'. Any conventional extinguishing agent other than halon, but having similar fire extinguishing characteristics as halon, may be used in the system according to the invention. Such alternative agents are preferred since they have a smaller or no environmental impact.

Initially, the pyrotechnically openable closures or gates 2A and 3A with their frangible membranes assure that the agent 16 is not discharged from the containers 2 and 3 as long as there is no fire. When a fire has started these membranes are destroyed and hence can no longer be reused. The destruction of the membranes can be performed by operating an electric switch in the cockpit or by a signal from the control unit 4 or from the heat sensor HS.

The temperature sensor 21 and the pressure sensor 20 may be housed in separate housings. However, the use of a single housing is preferred for safety and weight reasons. The temperature sensor 21 provides a signal that represents the temperature of the agent 16 in the pipe section that leads through the housing of the sensor unit 6. The pressure sensor 20 provides a signal representing the pressure in the pipe section passing through the housing of the sensor unit 6. These pressure and temperature representing signals are transmitted as feedback signals through the sensor conductor or sensor bus 19 to an input of the control unit 4. The control unit 4 with its computer and memory generates a control signal that is transmitted through the control conductor or bus 18 to the valve 5. The valve 5 is preferably operated by a solenoid. However, other electrically operating valves may be used such as piezoelectrically operable valves. Any other suitably controllable valves may be used. Thus, the control unit 4 can control in closed loop fashion the flow of agent 16 by opening or closing the valve 5 as required, whereby the use of flow restrictors is avoided.

In operation, an example embodiment of the present invention with two containers 2 and 3 functions as follows. A signal provided by the heat sensor HS in the enclosed space 13 is transmitted to the cockpit or to the control unit 4. In response thereto the membrane closure 2A of the container 2 is first destroyed so that extinguishing agent 16 flows freely through the pipe 11 and pipe system 10 into the enclosed space 13. The flow of agent 16 continues initially under higher pressure until pressure equalization in the container 2 and in the enclosed space 13 when the container 2 is substantially emptied. As a result, an initial concentration A of fire extinguishing agent 16 is established in the space 13 which leads to a rapid suppression or extinction of a started fire.

In order to prevent a rekindling, the frangible closure 3A is destroyed when the discharge of agent 16 from the container 2 stops or the closure is destroyed simultaneously with the closure membrane 2A. In the latter case the valve 5 remains closed until more agent 16 is needed. Then, the discharge from the container 3 is controlled by the control unit 4 which operates the valve 5 in closed loop fashion. As long as the valve 5 is opened, the agent 16 passes through the pipe sections 15, the filter unit 7, the sensor unit 6, and the valve 5, the pipe section 12 and the pipe system 10 into the space 13. This flow will occur as long as the valve 5 is opened and the pressure in the container 3 is higher than in the enclosed space 13. According to the invention no pressure reducer is used in the just described flow path through the components 15, 7, 6, 5 and 12. In accordance with the invention the valve 5 is opened only in order to maintain a minimal agent concentration M in the space 13 as determined by respective parameters stored in the memory of the control unit 4. This minimal concentration is sufficient to prevent a rekindling of the fire in the space 13. When the concentration approaches the predetermined minimal concentration, the valve is opened again to make sure that the agent concentration in the space 13 is never less than the predetermined minimal concentration M, thereby preventing the rekindling of a fire.

In a preferred operation of the present system, the two frangible closure membranes 2A and 3A are destroyed simultaneously but the valve 5 remains closed until the fire extinguishing agent 16 out of the container 2 has been completely discharged into the space 13, thereby flooding the space 13 to quickly reach the initial agent concentration A which leads to a rapid extinction or suppression of any started fire. Alternatively, the valve 5 can be immediately opened as the container 2 becomes empty so there is no delay in the further supply of extinguishing agent 16 into the space 13. The intermittent feeding of agent 16 out of the second container 3 can then continue to maintain the minimal concentration M of the agent 16 in the space 13. The simultaneous destruction of the membranes 2A and 3A may also be advantageous where a large amount of agent 16 is required immediately. In that event, the valve 5 is also opened simultaneously with the opening of the closure membrane 3A so that both containers 2 and 3 feed agent 16 simultaneously into the space 13.

Incidentally, the agent containers 2, 2' and 3 may be equipped with further components not shown, such as an excess pressure relief valve, a filling port, a remaining content indicator, an opening for inspections, sensor openings, viewing windows and the like.

The control unit 4 constantly monitors the pressure of the fire extinguishing agent 16 just upstream of the valve 5 with the pressure sensor 20.The conrol unit 4 also monitors the temperature of the extinguishing agent also just upstream of the valve 5 with the temperature sensor 21. The preferred position of the sensors 20 and 21 is near the outlet of the container 3 upstream of valve 5. The computer of the control unit 4 calculates the time durations during which the valve 5 must be open while the opening frequency remains constant. For example, if the pressure in the second container 3 falls due to repeated discharge of extinguishing agent, the control unit 4 must increase the opening duration of the valve 5 since the density of the fire extinguishing agent is being reduced by the pressure drop. Further, if the temperature in the area of the sensor unit 6 decreases the opening duration of the valve unit 5 may be reduced since the density of the agent increases, whereby the minimal agent concentration M in the space 13 can be maintained with a smaller quantity of agent 16.

Alternatively to controlling the discharge duration in response to temperature and/or pressure measurements, it is possible to control the frequency of opening the valve 5 in response to pressure and/or temperature measurements. In that case the opening duration could be maintained constant. Further, duration control and frequency control of the operation of the valve 5 could be combined.

In order to properly calculate the required opening duration of the valve 5 it is necessary to store in the memory of the control unit 4 the initial density and viscosity values as well as changes of the values in response to pressure reductions due to outflow of the extinguishing agent 16 during all operating states of the firefighting system 1. This information may be gathered empirically and provided in tables stored in the memory of the control unit 4. Further, it is necessary to ascertain a mean mass flow and the pressure loss of the agent 16 in the pipe system 10 as discharge from the containers continues. This information needs to be ready for call-up by the control unit 4. Additionally, the size and geometry of the space 13 needs to be taken into account when calculating the opening time durations of the valve 5. The above mentioned initial extinguishing agent concentration A and the minimal extinguishing agent concentration M depend on the size and geometry of the space 13. Furthermore, the control unit 4, the sensing unit 6, and the valve 5 must remain operable independently of a standard energy supply so that in case of a fire this equipment can continue to be supplied with electrical energy from an auxiliary or emergency power supply in order to assure the operation of the firefighting system 1 in an emergency.

Discharging the fire extinguishing agent 16 from the container 3 intermittently has the advantage that icing of the system 1 can be avoided. Such icing, as mentioned above, may occur when the agent 16 continuously expands rapidly. Further, avoiding a pressure reducer, avoids that such a pressure reducer can be clogged by ice and other contaminations that may be present in the agent 16. Thus, the reliability of the present system 1 is substantially increased and its safe operation assured with any pressure restrictor.

Figure 2:
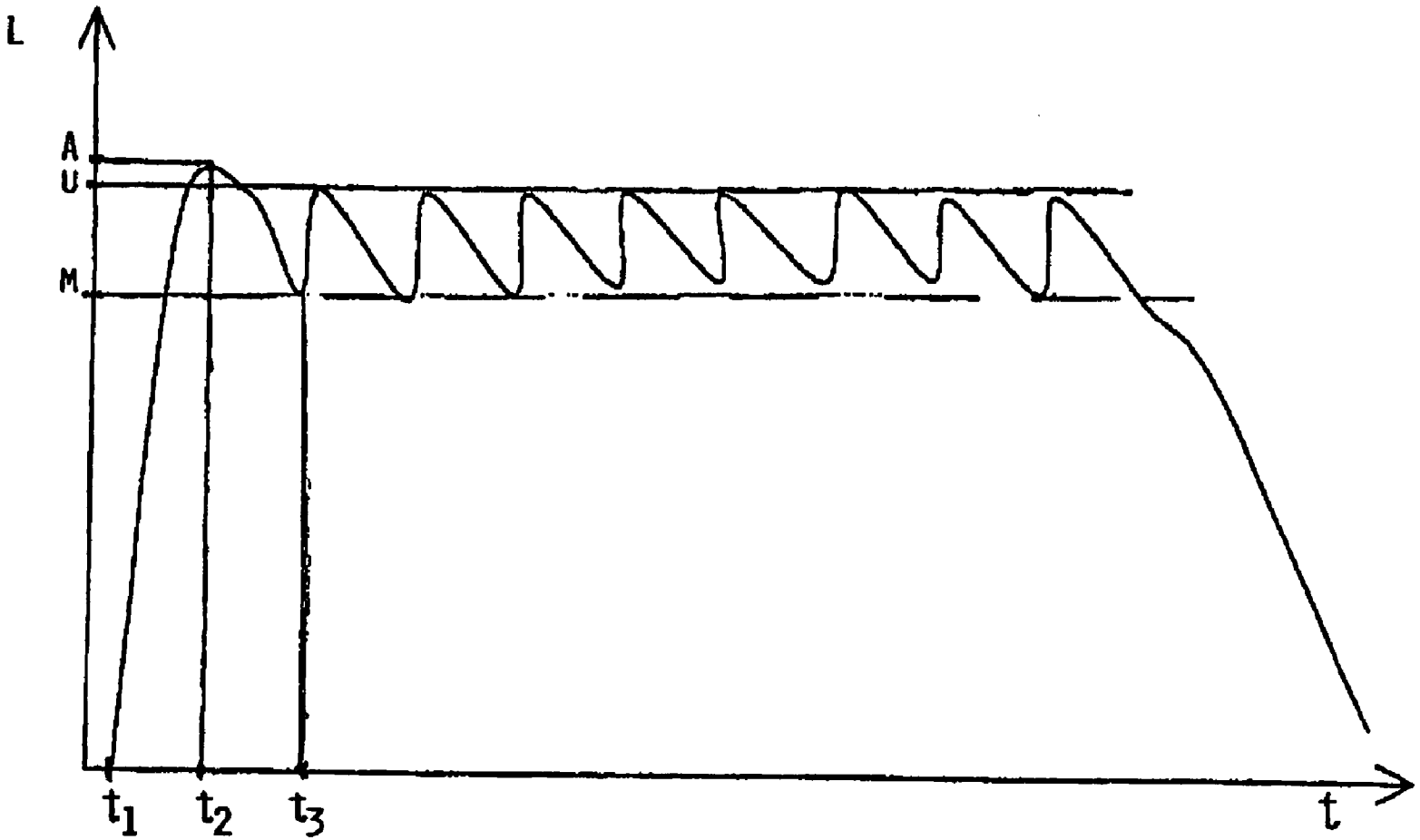
FIG. 2 illustrates the different or varying concentrations of fire extinguishing agent in the enclosed space as a function of time.

FIG. 2 shows along the ordinate the concentration L of fire extinguishing agent as a function of time. At the point of time t1 a fire starts in the enclosed space 13. The discharge of firefighting agent 16 into the space 13 begins at the time t1 substantially without delay. At the point t2 the space 13 already holds an initial concentration A of fire extinguishing agent. This initial concentration A is sufficient to immediately suppress or extinguish the fire in the space 13. This immediate saturation or flooding of the space 13 with fire extinguishing agent 16 is achieved by the direct unrestricted or unthrottled discharge of agent 16 out of the first container 2. However, as the pressure in the container 2 decreases due the discharge of agent 16 the initial concentration A decreases to a point of time t3 . During the time duration between t1 and t3 the second container 3 is not yet opened. More specifically, the control unit 4 has not yet opened the valve 5. However, as soon as the concentration of the fire extinguishing agent in the space 13 approaches a minimal concentration M required for keeping a fire suppressed or rather from rekindling, the valve 5 is opened and agent 16 flows out of the container 3 through the valve 5, the pipe section 12 and the pipe system 10 into the enclosed space 13. Thus, the concentration of firefighting agent in the space 13 fluctuates as shown in FIG. 2 between an upper level U and a minimal level M. The supply of agent 16 out of the container 3 is so controlled that the agent concentration is maintained sufficiently above the minimum concentration M to thereby prevent any rekindling in the space 13.

If the present system is, for example, installed in an aircraft, the intermittent or periodic discharge of agent 16 out of the container 3 is repeated until the aircraft lands safely. It should be noted, that the present system is useful, not only in an aircraft, but in any enclosed space, even in a vehicle such as a passenger vehicle.

The present invention can also be practiced with a single container 3. In such an embodiment the single container 3 is connected as shown in FIG. 1 through the components 5, 6, 7 and the pipe sections 12 and 15 to the distribution pipe system 10. In such an embodiment the control unit 4 opens the valve 5 substantially simultaneously with the destruction of a closure member or membrane 3A and keeps the valve 5 open until the agent concentration A is reached in the space 13. As mentioned, this initial high concentration A leads to a rapid suppression of the fire. Thereafter, the valve 5 is intermittently opened and closed by the control unit 4 so that the further supply of fire extinguishing agent 16 into the space 13 takes place periodically under a required high pressure.

According to the invention it is sufficient if one container such as the container 3 is connected through the components 5, 6 and 7 to the pipe system 10 regardless of the number of additional containers 2, 2'. Only one container needs to be equipped as just mentioned which is an economic, cost reducing feature of the invention. In this embodiment an initial fire suppressing concentration A of agent 16 is supplied from the same container 3 into the space 13. This initial discharge is followed by an intermittent discharge of agent to maintain the agent concentration above a minimum. Even using a single container assures that at no time will the agent concentration in the space 13 fall below the minimal concentration M.

In all embodiments of the invention having a single container equipped as taught by the invention or a plurality of containers, one of which is equipped as taught by the invention, it is possible to control the valve 5 in response to the pressure and/or temperature as measured by the sensor unit 6. The opening duration and/or the frequency of the opening of the valve 5 may be controlled to achieve the discharge pattern illustrated in FIG. 2. The opening duration may be kept constant while the frequency is changed. The opening duration may, on the other hand, be increased when the frequency is decreased and vice versa.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for extinguishing a fire in an enclosed space (13), said apparatus comprising at least one container (3) for holding a fire extinguishing agent (16) at a pressure sufficient to keep said fire extinguishing agent liquified, said fire extinguishing agent gasifying at atmospheric pressure, said apparatus further comprising a pipe system (10, 12, 15) connecting an outlet (3A) of said at least one container (3) to said enclosed space (13), a controllable flow control valve (5) in said pipe system (10) between said at least one container (3) and said enclosed space (13), a sensor unit (6) including an agent pressure sensor (20) for measuring a pressure of said fire extinguishing agent and an agent temperature sensor (21) for measuring a temperature of said fire extinguishing agent, said sensor unit (6) being positioned between said controllable flow control valve (5) and said outlet (3A) of said at least one container (3), said apparatus further comprising a control unit (4) having a control output operatively connected to said controllable flow control valve (5) and an input (19) operatively connected to said sensor unit (6) for receiving any one of an agent temperature signal representing a temperature of said fire extinguishing agent exiting from said at least one container and an agent pressure signal representing a pressure of said fire extinguishing agent being discharged from said at least one container (3), wherein said control unit (4) controls a valve opening duration of said controllable flow control valve (5) in response to any one of said agent temperature signal and said agent pressure signal of said fire extinguishing agent so that a minimal concentration of fire extinguishing agent is maintained in said enclosed space sufficient to prevent a rekindling of said fire.

2. The apparatus of claim 1, wherein said controllable flow control valve (5) is an electrically operable valve for discharging said fire extinguishing agent under pressure into said pipe system.

3. The apparatus of claim 1, comprising at least one further container (2) for holding a fire extinguishing agent under pressure, a pipe (11) directly connecting said at least one further container (2) to said pipe system (10) and further comprising a gate (2A) positioned for establishing a flow path between said at least one further container (2) and said pipe system (10) for discharging from said at least one further container fire extinguishing agent into said enclosed space in response to opening of said gate, wherein a content of fire extinguishing agent (16) in said at least one further container is sufficient for establishing in said enclosed space (3) an initial concentration (A) of fire extinguishing agent sufficient for suppressing a fire in said enclosed space (13).

4. The apparatus of claim 3, further comprising a control connection (18) between said output of said control unit (4) and said gate (2A) of said further container (2) for simultaneously or sequentially discharging fire extinguishing agent from said at least one container and said at least one further container.

5. The apparatus of claim 1, comprising a plurality of additional containers for holding fire extinguishing agent, said additional containers being directly connected to said pipe system (10, 11) so that only said at least one container (3) is connected to said pipe system through said controllable flow control valve (5) and said additional containers are directly connected to said enclosed space.

6. The apparatus of claim 1, wherein said control unit (4), said controllable flow control valve (5), said agent temperature sensor (21) and said agent pressure sensor (20) are operatively interconnected to form a closed loop control circuit responsive to any one of said agent temperature signal and said agent pressure signal for controlling said valve opening duration and/or a valve opening frequency.

* * * * *